US012747509B2

(12) United States Patent
Zhang et al.

(10) Patent No.: US 12,747,509 B2
(45) Date of Patent: Sep. 29, 2026

(54) SYSTEM AND METHODS OF WATER ELECTROLYSIS

(71) Applicant: Schlumberger Technology Corporation, Sugar Land, TX (US)

(72) Inventors: Wenlin Zhang, Menlo Park, CA (US); Rafael Fejervary, Houston, TX (US); Alan Nelson, Houston, TX (US); Eric Lavrut, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 70 days.

(21) Appl. No.: 18/956,030

(22) Filed: Nov. 22, 2024

(65) Prior Publication Data

US 2025/0389033 A1 Dec. 25, 2025

Related U.S. Application Data

(60) Provisional application No. 63/663,756, filed on Jun. 25, 2024.

(51) Int. Cl.

| | |
|---|---|
| ***C25B 9/65*** | (2021.01) |
| ***C25B 1/04*** | (2021.01) |
| ***C25B 9/73*** | (2021.01) |
| ***C25B 15/023*** | (2021.01) |

(52) U.S. Cl.

CPC ..... *C25B 9/65* (2021.01); *C25B 1/04* (2013.01); *C25B 9/73* (2021.01); *C25B 15/023* (2021.01)

(58) Field of Classification Search

CPC ..... C25B 1/04

See application file for complete search history.

(56) References Cited

U.S. PATENT DOCUMENTS

2016/0281248 A1* 9/2016 Hahn ..... C25B 9/70
2021/0115573 A1 4/2021 Tanaka et al.

FOREIGN PATENT DOCUMENTS

| | | |
|---|---|---|
| CN | 219409921 U | 7/2023 |
| JP | 2000254646 A | 9/2000 |
| JP | 2007270292 A | 10/2007 |

OTHER PUBLICATIONS

Peng, S., Alkaline Water Electrolysis, Electrochemical Hydrogen Production from Water Splitting, Chapter 3, Aug. 23, 2023, pp. 57-68.

Brauns. J. et al., Alkaline Water Electrolysis Powered by Renewable Energy: A Review, Processes, 2020, pp. 1-23, vol. 8, No. 2.

Advanced Liquid Alkaline Water Electrolysis Experts Meeting, Hydrogen and Fuel Cell Technologies Office, U.S. Department of Energy, Jan. 2022, 39 Pages.

* cited by examiner

*Primary Examiner* — Alexander W Keeling
(74) *Attorney, Agent, or Firm* — Kyle R. Miiller

(57) ABSTRACT

The present disclosure generally provides systems and methods of water electrolysis. The methods include providing a first power between a first terminal plate of a first section and a second segment plate of a second section. The first section is defined by the first terminal plate and a first segment plate. The second section is defined by the first segment plate and the second segment plate. A first power fluctuation is determined from the first power to a second power. The second voltage is transmitted from the first terminal plate to the first segment plate.

10 Claims, 3 Drawing Sheets

SYSTEM AND METHODS OF WATER ELECTROLYSIS

CROSS-REFERENCE TO RELATED APPLICATIONS

This application claims priority to U.S. Provisional Patent Application No. 63/663,756, filed Jun. 25, 2024, the entirety of which is herein incorporated by reference.

BACKGROUND

Electrolysis of water is utilized for the production of hydrogen ($H_2$) to be used as an alternative energy storage and green hydrogen for hard-to-abate heavy industries such as chemical and steel industries. Electrolysis of water requires water as a feed material and converts, using an electrochemical cell, water into $H_2$ and oxygen ($O_2$) via a redox reaction by applying an external electrical power to the cell. Electrolysis of water is generally implemented by an electrolyzer system that includes one or more electrochemical cells. Electrolyzer cells make use of an electrochemical reaction in a cell that comprises an anode, cathode, catalyst, gas/liquid distribution field and electrolyte.

Renewable energy sources provide intermittent energy inputs, leading to varying power levels, which disrupt the stable operation of the electrolyzer cells. Moreover, at low power the electrolyzer cells can cause safety concerns due to increased hydrogen-to-oxygen (HTO) ratios. Conventional approaches to utilize intermittent energy inputs have focused on utilizing pressurized alkaline electrolyzers, which can respond rapidly, e.g., within a few minutes, to fluctuating energy inputs. However, due to the HTO issues at lower energy inputs, and the associated safety concerns, pressurized alkaline electrolyzers are generally only operable between 50% and 100% of the rated power, thereby resulting in narrow operating ranges and lower utilization of renewable power generation systems. Moreover, an increase in the levelized cost of hydrogen (LCOH) occurs once the renewable energy source drops below 50% of the electrolyzer rated power due to the shutting down of the stack causing lower utilization of the capital expenditure.

Accordingly, improved methods of water electrolysis are needed.

SUMMARY

In an aspect, the present disclosure generally provides systems for electrolyzing water. The systems include a first section defined by a first terminal plate and a first segment plate. The first section includes at least one electrolyzer cell. The at least one electrolyzer cell includes a first electrode disposed adjacent to the terminal plate and in electrical contact with the terminal plate. A second electrode is disposed adjacent to the first side of the first segment plate and in electrical contact with the first segment plate. The system includes a second section defined by the first segment plate and a second segment plate. The second section includes a at least one electrolyzer cell. The at least one electrolyzer cell includes a third electrode disposed adjacent to a second side of the first segment plate and in electrical contact with the first segment plate. The first side of the first segment plate opposite the second side of the first segment plate. A fourth electrode is disposed adjacent to the first side of the second segment plate and in electrical contact with the first side of the second segment plate. A power source terminal is electrically coupled to the first terminal plate, and the second segment plate.

In another aspect, the present disclosure generally provides methods of electrolyzing water. The methods include providing a first power between a first terminal plate of a first section and a second segment plate of a second section. The first section is defined by the first terminal plate and a first segment plate. The second section is defined by the first segment plate and the second segment plate. A first power fluctuation is determined from the first power to a second power. The second voltage is transmitted from the first terminal plate to the first segment plate.

In another aspect, the present disclosure generally provides methods of electrolyzing water. The methods include providing a first power between a first terminal plate of a first section and a second terminal plate of a third section. The first section is defined by the first terminal plate and a first segment plate. The third section is defined by a second segment plate and the second terminal plate. A second section is disposed between the first section and the third section. The second section is defined by the first segment plate and the second segment plate. A first power fluctuation is determined from the first power to a second power. The second power is transmitted from the first terminal plate to the second segment plate.

The following description and the appended figures set forth certain features for purposes of illustration.

BRIEF DESCRIPTION OF DRAWINGS

So that the manner where the above recited features may be understood in detail, a more particular description, briefly summarized above, may be had by reference to example aspects, some of which are illustrated in the appended drawings.

DETAILED DESCRIPTION

One or more specific embodiments of the present disclosure will be described herein. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure relates to systems and methods of water electrolysis. The present disclosure includes an electrolyzer having a multi-section stack of electrolyzer cells.

The multi-section stack allows each section of the multi-section stack to have independent, but coordinated and intelligently synchronized, power distributed throughout the multi-section stack, thereby allowing for independent control of each section of electrolyzer cells. The independent, but coordinated and intelligently synchronized, power of the multi-section stack can allow for renewable energy power output to match the full scale of the rated electrolyzer's power by re-directing the power to one or more sections such that when the renewable power decreases, the power can be re-directed to maintain at least 50% of the rated power for one or more sections of the multi-section stack.

Figure 1:
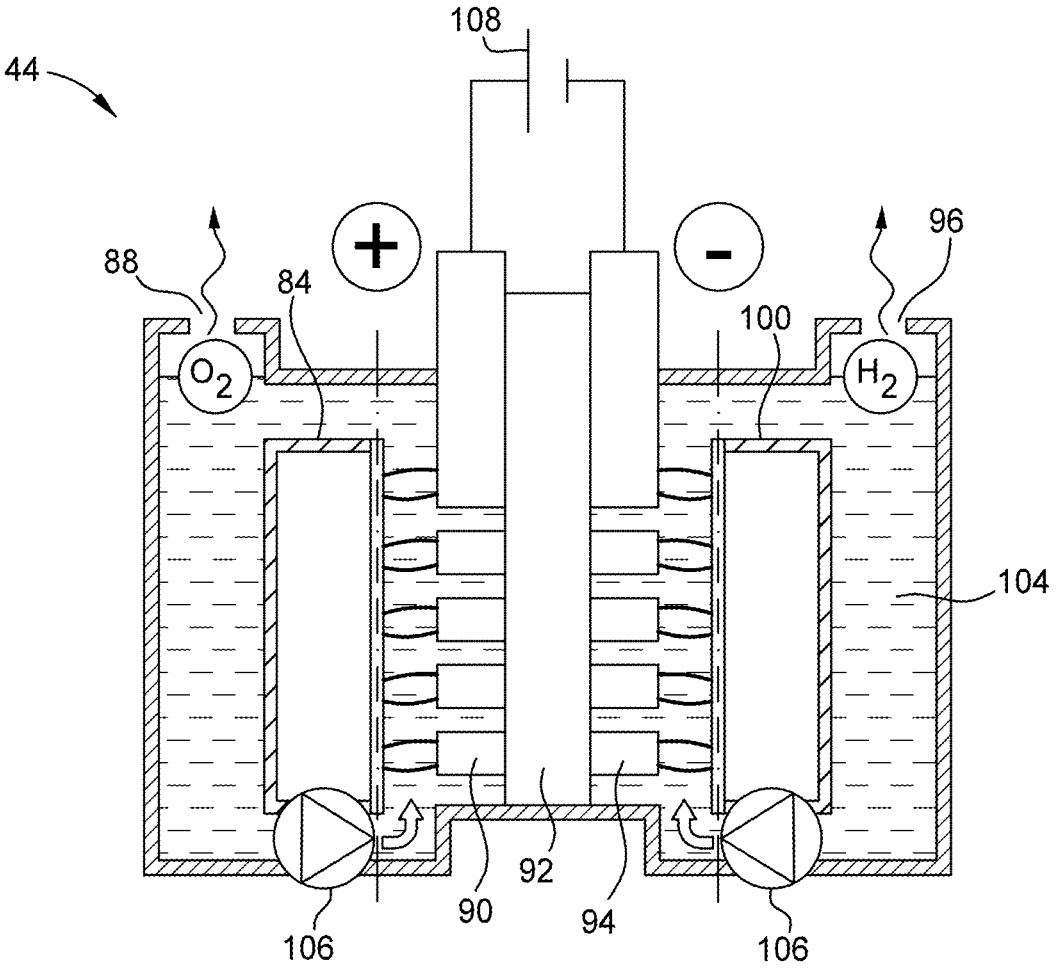
FIG. 1 is a schematic view of an electrolyzer cell, according to embodiments of the present disclosure.

FIG. 1 shows a detailed view of the electrolyzer cell 44. In this view only one electrolyzer cell is shown, however, two or more electrolyzer cells may be coupled in series in order to produce more hydrogen. The electrolyzer cell 44 includes a first bipolar plate 84 that is adjacent to a first channel 88 and a first electrode 90. The first channel 88 may be a channel suitable to recover one or more reaction products of an electrolysis reaction, e.g., $H_2$ and/or $O_2$. For example, the first channel 88 may be suitable to recover a reaction product of $O_2$. A positive charge may be supplied to the first bipolar plate 84 via a power source 108. The first bipolar plate 84 is electrically coupled to the first electrode 90. The first electrode 90 can include a conductive material, e.g., a nickel mesh. The first electrode 90 is a mesh material, thereby allowing for electrolysis reaction products, e.g., gaseous bubbles such as $O_2$, to form.

Adjacent to the first electrode 90 is a diaphragm 92. The diaphragm 92 can be non-conductive to electrons. The diaphragm 92 can include a composite material, e.g., Zirconia and polysulfone. Without being bound by theory, the diaphragm 92 can allow $OH^-$ ions to pass through the diaphragm 92, while restricting $H_2$ and $O_2$ gases from passing through.

Adjacent to the diaphragm 92 is a second electrode 94 and a second channel 96. The second channel 96 may be a channel suitable to recover one or more reaction products of an electrolysis reaction, e.g., $H_2$. For example, the second channel 96 may be suitable to recover a reaction product of $H_2$. The second electrode 94 can include a conductive material, e.g., a nickel mesh. The second electrode 94 is a mesh material, thereby allowing for electrolysis reaction products, e.g., gaseous bubbles such as $H_2$, to form. Adjacent to the second electrode 94 is a second bipolar plate 100. A negative charge may be supplied to the second bipolar plate 100 via the power source 108. The second bipolar plate 100 is electrically coupled to the second electrode 94.

The electrolyzer cell 44 is immersed in an electrolyte solution 104. The electrolyte solution 104 includes an alkaline solution, e.g., a solution having a pH greater than 7, e.g., greater than 7.5, greater than 8, greater than 9, greater than 10, or greater than 11. The alkaline solution can include an aqueous solution having an electrolyte, e.g., a hydroxide electrolyte. For example, the electrolyte solution can include a mixture of water and potassium hydroxide. The electrolyzer cell 44 receives water and/or electrolyte solution 104 from a pump 106. The pump 106 can include any pump suitable to circulate an aqueous fluid, e.g., water and/or the electrolyte solution 104.

In operation, the electrolyzer cell 44 may receive a positive charge at the first bipolar plate 84 and a negative charge at the second bipolar plate 100, thereby creating a voltage difference across the first electrode 90 and the second electrode 94, which is separated by the diaphragm 92. Due to the voltage difference and the supply of aqueous water from the pump 106, water may be reduced on the second electrode 94 to form $H_2$. The $H_2$ may then diffuse and be directed out of the second channel 96, e.g., via convectional flow. The $OH^-$ may transfer through the diaphragm and be oxidized on the first electrode 90 to produce $H_2O$ and $O_2$. The $O_2$ may diffuse and be directed out the first channel 88, e.g., via convectional flow, in which the $H_2O$ may recirculate throughout the electrolyzer cell 44 to be further reacted.

While the electrolyzer 44 described herein is in reference to an alkaline electrolyzer, any suitable electrolyzer may be implemented. For example, the electrolyzer 44 can include a solid oxide electrolyzer. The solid oxide electrolyzer can include an electrolyzer suitable for producing hydrogen gas via electrolysis of water, possibly with co-electrolysis of carbon dioxide. The solid oxide electrolyzer can include a solid electrolyte such as zirconium dioxide and yttrium(III) oxide and working at a high temperature (generally 700°-1000° C.). The solid oxide electrolyzer can include a cathode including a nickel doped yttria-stabilized zirconia and/or a perovskite-type lanthanum strontium manganese cathode. The solid oxide electrolyzer can include an anode, e.g., lanthanum strontium manganite, neodymium nickelate, and/or lanthanum strontium manganite doped with gadolinium doped ceric oxide.

As a further example, the electrolyzer 44 can include a proton exchange membrane electrolyzer. The proton exchange membrane electrolyzer can include an electrolyzer suitable for producing hydrogen gas via electrolysis of water and uses a membrane (for instance made of perfluorosulfonic acid) permeable to H+ ions in order to transport the H+ ions from the anode to the cathode. Such electrolyzer are operated a low temperature (ca. 50-80°C). As a further example, the electrolyzer 44 can include an anion exchange membrane electrolyzer. The anion exchange membrane electrolyzer can include an electrolyzer suitable for producing hydrogen gas via electrolysis of water. The anion exchange membrane electrolyzer includes an anion exchange membrane to transport hydroxide ions from the cathode to the anode and made of a polymer electrolyte, such as poly(fluorenyl-co-aryl piperidinium) (PFAP). Such anion exchange membrane are operated at low temperature (ca. 40-80°C). All of the electrolyzer have the same structure, ie a stack including multiple cells in series, each having an anode and a cathode connected to a terminal plate, as described in relationship with the alkaline electrolyzer in the attached. For other electrolyzer cells, the above mentioned diaphragm refers to solid oxide ceramic membrane, or proton exchange membrane or anion exchange membrane, for solid oxide electrolyzer cell, or proton exchange membrane electrolyzer cell or cation exchange membrane electrolyzer cell, respectively.

Figure 2:
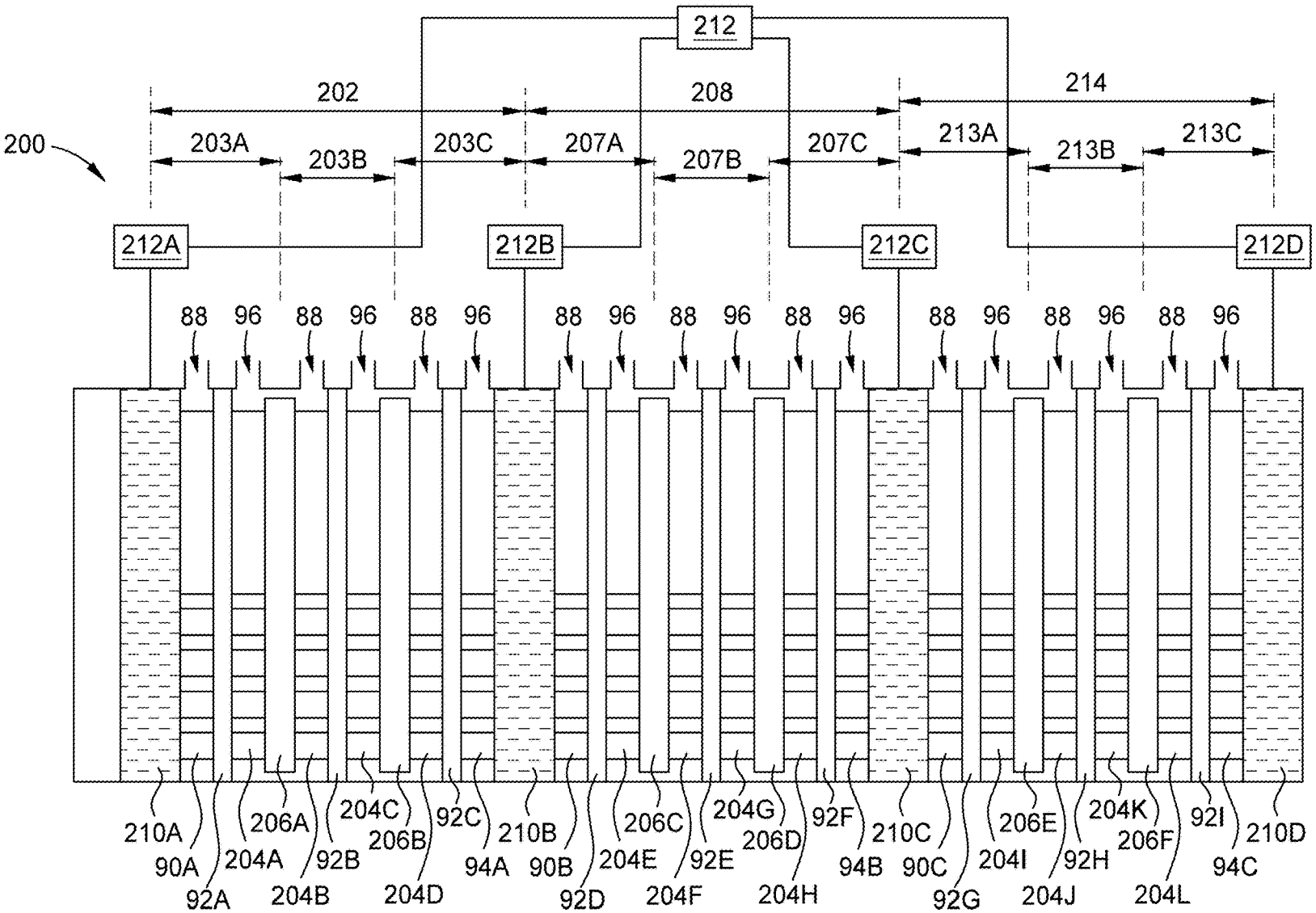
FIG. 2 is a schematic view of a plurality of electrolyzer cells, according to embodiments of the present disclosure.

FIG. 2 shows a detailed view of a multi-section stack electrolyzer 200. While FIG. 2 shows a multi-section stack electrolyzer having three sections, any number of sections may be implemented within the multi-section stack electrolyzer, e.g., about 2 sections to about 100 sections. The multi-section stack electrolyzer includes a first section 202. The first section 202 is defined by a first terminal plate 210A and a first segment plate 210B. The first terminal plate 210A can include a polar plate, i.e., a monopolar plate or end plate. A polar plate and the first segment plate 210B can be configured to receive a power between a first power source terminal 212A and a second power source terminal 212B. The first power source terminal 212A may be a positive pole of a power source and the second power source terminal 212B may be a negative pole of the power source. The first segment plate 210B can include a bipolar plate, e.g., a bipolar plate as described herein. The bipolar plate can include a plate configured to perform cathodic and anodic reactions on the two opposite sides. The first power source terminal 212A and the second power source terminal 212B can provide a power to the first section of the stack. In an embodiment, the first power source terminal 212A and the second power source terminal 212B are connected respectively with a first and second power output from a DC power source 212, such as a renewable energy source. In an embodiment, the first power source terminal 212A and the second power source terminal 212B are the same. In an embodiment, the first power source terminal 212A and the second power source terminal 212B are different.

The first section 202 includes a plurality of single cells and/or a plurality of multiple cells, each including a pair of electrodes and a diaphragm 92, as described in relationship with FIG. 1. A first electrode 90A disposed adjacent to the first terminal plate 210A and in electrical contact with the first terminal plate 210A. The first electrode 90A can include any of the electrode described herein. The first section 202 includes a second electrode 94A disposed adjacent to a first side of the first segment plate 210B. The second electrode 94A is in electrical contact with the first side of the first segment plate 210B. The power provided to the first section 202 can be about 17% to about 34% of the overall stack rated power.

A first diaphragm is disposed between the first electrode 90A and the second electrode 94A. The diaphragm can include any of the diaphragm 92 as described herein. While FIG. 2 shows three diaphragms disposed between the first electrode 90A and the second electrode 94A, any number of diaphragms can be implemented in the first section 202. The diaphragm can separate the first electrode 90A and the second electrode 94A from an intermediary electrode 204, in which the intermediary electrode 204 is disposed between the second electrode 94A and the first electrode 90A. While only four intermediary electrodes 204 are shown in FIG. 2, the first section 202 can include any number of intermediary electrodes 204 disposed between the first electrode 90A and the second electrode 94A.

The first section 202 includes one or a first plurality of electrolyzer cells. In the example below, it includes three cells. The first section 202 can include a first electrolyzer cell 203A. The first electrolyzer cell 203A is defined by a first terminal plate 210A and a first intermediary bipolar plate 206A. The first intermediary bipolar plate 206A can include any of the bipolar plate described herein. The first terminal plate 210A is electrically coupled to a first electrode 90A (for instance a cathode) adjacent to a first diaphragm 92A. The first diaphragm 92A is adjacent to a first intermediary electrode 204A having a polarity opposed to the electrode 90A (for instance an anode), which is electrically coupled to the first intermediary bipolar plate 206A. The first electrolyzer cell 203A is fluidly coupled to a first channel 88 and a second channel 96 to collect one or more reaction products of an electrolysis reaction, e.g., $O_2$ and $H_2$, respectively.

The first section 202 can include a second electrolyzer cell 203B. The second electrolyzer cell 203B is defined by the first intermediary bipolar plate 206A and a second intermediary bipolar plate 206B. The second intermediary bipolar plate 206B can include any of the bipolar plate described herein. The first intermediary bipolar plate 206A is electrically coupled to a second intermediary electrode 204B of the same polarity as electrode 90A (for instance a cathode) adjacent to a second diaphragm 92B. The second diaphragm 92B is adjacent to a third intermediary electrode 204C of the same polarity as electrode 204A (for instance an anode), which is electrically coupled to the second intermediary bipolar plate 206B. The second electrolyzer cell 203B is fluidly coupled to the first channel 88 and a second channel 96 to collect one or more reaction products of an electrolysis reaction, e.g., $O_2$ and $H_2$, respectively.

The first section 202 can include a third electrolyzer cell 203C. The third electrolyzer cell 203C is defined by the second intermediary bipolar plate 206B and the first segment plate 210B. The first segment plate 210B can be coupled to a second power source terminal 212B, thereby providing a positive and/or negative charge to the first segment plate 210B. The second power source terminal provides a charge that may be the opposite as the charge of the first power source terminal 212A, i.e. if the first power source terminal provides a positive charge, the second power source terminal provides a negative charge. The second intermediary bipolar plate 206B is electrically coupled to a fourth intermediary electrode 204D of the same polarity as electrode 90A (for instance a cathode) adjacent to a third diaphragm 92C. The third diaphragm 92C is adjacent to the second electrode 94A of the same polarity as electrode 204A (for instance an anode), which is electrically coupled to the first segment plate 210B. The third electrolyzer cell 203C is fluidly coupled to the first channel 88 and a second channel 96 to collect one or more reaction products of an electrolysis reaction, e.g., $O_2$ and $H_2$, respectively.

In some embodiments, the electrolyzer cells 203A-203C are alkaline electrolyzer cells. In some embodiments, the electrolyzer cells 203A-203C are solid oxide electrolyzer cells. In some embodiments, the electrolyzer cells 203A-203C are proton exchange membrane electrolyzer cells. In some embodiments, the electrolyzer cells 203A-203C are anion exchange membrane electrolyzer cells.

The multi-section stack electrolyzer includes a second section 208. The second section 208 is defined by the first segment plate 210B and a second segment plate 210C. The second segment plate 210C can include a bipolar plate, e.g., a bipolar plate as described herein. The bipolar plate can perform cathodic and anodic reactions on the two opposite sides. The second section 208 can be configured to receive a DC power between the second power source terminal 212B and the third power source terminal 212C. The power provided to the second section 208 can be about 17% to about 34% of the overall stack rated power.

The second section 208 includes a third electrode 90B disposed adjacent to a second side of the first segment plate 210B and in electrical contact with the first segment plate 210B. The third electrode 90B can include any of the electrode described herein. The second section 208 includes a fourth electrode 94B disposed adjacent to a first side of the second segment plate 210C. The fourth electrode 94B is in electrical contact with the first side of the second segment plate 210C.

A diaphragm is disposed between the third electrode 90B and the fourth electrode 94B. The diaphragm can include any of the diaphragm 92 as described herein. While FIG. 2 shows three diaphragms disposed between the third electrode 90B and the fourth electrode 94B, any number of diaphragms can be implemented in the second section 208. The diaphragm can separate the third electrode 90B and the fourth electrode 94B from an intermediary electrode 204, in which the intermediary electrode 204 is disposed between the third electrode 90B and the fourth electrode 94B. While only four intermediary electrodes 204 are shown in FIG. 2, the second section 208 can include any number of intermediary electrodes 204 disposed between the third electrode 90B and the fourth electrode 94B.

The second section 208 includes one or a second plurality of electrolyzer cells. In the example below, it includes three cells. The second section 208 can include a first electrolyzer cell 207A. The first electrolyzer cell 207A is defined by a first segment plate 210B and a third intermediary bipolar plate 206C. The third intermediary bipolar plate 206C can include any of the bipolar plate described herein. The first segment plate 210B is electrically coupled to a third electrode 90B (for instance a cathode) adjacent to a fourth diaphragm 92D. The fourth diaphragm 92D is adjacent to a fifth intermediary electrode 204E having a polarity opposed to the third electrode 90B (for instance an anode), which is electrically coupled to the third intermediary bipolar plate 206C. The first electrolyzer cell 207A is fluidly coupled to a first channel 88 and a second channel 96 to collect one or more reaction products of an electrolysis reaction, e.g., $O_2$ and $H_2$, respectively.

The second section 208 can include a second electrolyzer cell 207B. The second electrolyzer cell 207B is defined by the third intermediary bipolar plate 206C and a fourth intermediary bipolar plate 206D. The fourth intermediary bipolar plate 206D can include any of the bipolar plate described herein. The third intermediary bipolar plate 206C is electrically coupled to a sixth intermediary electrode 204F of the same polarity as the third electrode 90B (for instance a cathode), adjacent to a fifth diaphragm 92E. The fifth diaphragm 92E is adjacent to a seventh intermediary electrode 204G of the same polarity as the fifth intermediary electrode 204E (for instance an anode), which is electrically coupled to the fourth intermediary bipolar plate 206D. The second electrolyzer cell 207B is fluidly coupled to the first channel 88 and a second channel 96 to collect one or more reaction products of an electrolysis reaction, e.g., $O_2$ and $H_2$, respectively.

The second section 208 can include a third electrolyzer cell 207C. The third electrolyzer cell 207C is defined by the fourth intermediary bipolar plate 206D and the second segment plate 210C. The second segment plate 210C can be coupled to a third power source terminal 212C. The third power source terminal 212C provides a charge that may be the opposite as the charge of the first power source terminal 212A and/or the second power source terminal 212B, i.e. if the first power source terminal provides a positive charge, the third power source terminal provides a negative charge. The fourth intermediary bipolar plate 206D of the same polarity as electrode 204F (for instance a cathode) is electrically coupled to an eighth intermediary electrode 204H adjacent to a sixth diaphragm 92F of the same polarity as seventh intermediary electrode 204G (for instance an anode). The sixth diaphragm 92F is adjacent to the fourth electrode 94B, which is electrically coupled to the second segment plate 210C. The third electrolyzer cell 207C is fluidly coupled to the first channel 88 and a second channel 96 to collect one or more reaction products of an electrolysis reaction, e.g., $O_2$ and $H_2$, respectively.

In some embodiments, the electrolyzer cells 207A-207C are alkaline electrolyzer cells. In some embodiments, the electrolyzer cells 207A-207C are solid oxide electrolyzer cells. In some embodiments, the electrolyzer cells 207A-207C are proton exchange membrane electrolyzer cells. In some embodiments, the electrolyzer cells 207A-207C are anion exchange membrane electrolyzer cells.

The multi-section stack electrolyzer includes a third section 214. The third section 214 is defined by the second segment plate 210C and a second terminal plate 210D. The second terminal plate 210D can include a polar plate. The polar plate can include a plate configured to receive a positive or negative charge from a fourth power source terminal 212D. The power provided to the third section 214 can be about 17% to about 34% of the overall stack rated power.

The third section 214 includes a fifth electrode 90C disposed adjacent to a second side of the second segment plate 210C and in electrical contact with the second segment plate 210C. The fifth electrode 90C can include any of the electrode described herein. The third section 214 includes a sixth electrode 94C disposed adjacent to a first side of the second terminal plate 210D. The sixth electrode 94C is in electrical contact with the first side of the second terminal plate 210D.

A diaphragm is disposed between the fifth electrode 90C and the sixth electrode 94C. The diaphragm can include any of the diaphragm 92 as described herein. While FIG. 2 shows three diaphragms disposed between the fifth electrode 90C and the sixth electrode 94C, any number of diaphragms can be implemented in the third section 214. The diaphragm can separate the fifth electrode 90C and the sixth electrode 94C from an intermediary electrode 204, in which the intermediary electrode 204 is disposed between the fifth electrode 90C and the sixth electrode 94C. While only four intermediary electrodes 204 are shown in FIG. 2, the third section 214 can include any number of intermediary electrodes 204 disposed between the fifth electrode 90C and the sixth electrode 94C.

The third section 214 includes one or a third plurality of electrolyzer cells. In the example below, it includes three cells. The third section 214 can include a first electrolyzer cell 213A. The first electrolyzer cell 213A is defined by a second segment plate 210C and a fifth intermediary bipolar plate 206E. The fifth intermediary bipolar plate 206E can include any of the bipolar plate described herein. The second segment plate 210C is electrically coupled to a fifth electrode 90C (for instance a cathode) adjacent to a seventh diaphragm 92G. The seventh diaphragm 92G is adjacent to a ninth intermediary electrode 204I having a polarity opposite to the fifth electrode 90C (for instance an anode), which is electrically coupled to the fifth intermediary bipolar plate 206E. The first electrolyzer cell 213A is fluidly coupled to a first channel 88 and a second channel 96 to collect one or more reaction products of an electrolysis reaction, e.g., $O_2$ and $H_2$, respectively.

The third section 214 can include a second electrolyzer cell 213B. The second electrolyzer cell 213B is defined by the fifth intermediary bipolar plate 206E and a sixth intermediary bipolar plate 206F. The sixth intermediary bipolar plate 206F can include any of the bipolar plate described herein. The fifth intermediary bipolar plate 206E is electrically coupled to a tenth intermediary electrode 204J of the same polarity as fifth electrode 90C (for instance a cathode) adjacent to an eighth diaphragm 92H. The eighth diaphragm 92H is adjacent to an eleventh intermediary electrode 204K of the same polarity as the ninth intermediary electrode 204I (for instance an anode), which is electrically coupled to the sixth intermediary bipolar plate 206F. The second electrolyzer cell 213B is fluidly coupled to the first channel 88 and a second channel 96 to collect one or more reaction products of an electrolysis reaction, e.g., $O_2$ and $H_2$, respectively.

The third section 214 can include a third electrolyzer cell 213C. The third electrolyzer cell 213C is defined by the sixth intermediary bipolar plate 206F and the second terminal plate 210D. The second terminal plate 210D can be coupled to a fourth power source terminal 212D, thereby providing a positive or negative charge to the second terminal plate 210D. The fourth power source terminal 212D provides a charge that may be the opposite as the charge of the third power source terminal 212C, i.e. if the first power source terminal provides a positive charge, the fourth power source terminal provides a negative charge. The sixth intermediary bipolar plate 206F is electrically coupled to a twelfth intermediary electrode 204L of the same polarity as the tenth intermediary electrode 204J (for instance a cathode) adjacent to a ninth diaphragm 92I. The ninth diaphragm 92I is adjacent to the sixth electrode 94C of the same polarity as the eleventh intermediary electrode 204K, which is electrically coupled to the second terminal plate 210D. The third electrolyzer cell 213C is fluidly coupled to the first channel 88 and a second channel 96 to collect one or more reaction products of an electrolysis reaction, e.g., $O_2$ and $H_2$, respectively.

The power source is connectable to two power source terminals among the first, second, third and fourth power source terminals in a plurality of power transmission configuration, to allow powering one, two or three of the first, second and third stack sections. In an embodiment, the power source may have for instance a positive pole connected to the first power source terminal and a negative pole connectable to the second, third and fourth power source terminal (for instance via a switching device). In another embodiment, the power source may have for instance a positive pole connectable to the first, second or third power source terminals and a negative pole connected to the fourth power source terminal. In another embodiment, the power source may have for instance a positive pole connectable to the first, second or third power source terminals and a negative pole connectable to the second, third and fourth power source terminals. The computing device transmits a signal to the power source (and in particular the switching device(s)) so that it connects the appropriate power source terminals to the power source.

In some embodiments, the electrolyzer cells 213A-213C are alkaline electrolyzer cells. In some embodiments, the electrolyzer cells 213A-213C are solid oxide electrolyzer cells. In some embodiments, the electrolyzer cells 213A-213C are proton exchange membrane electrolyzer cells. In some embodiments, the electrolyzer cells 213A-213C are anion exchange membrane electrolyzer cells.

The multi-section stack electrolyzer includes one or more sensors, e.g., voltage sensors and/or current sensors to detect a voltage drop and/or current drop. The multi-section stack electrolyzer includes a computing device electrically coupled to the one or more sensors and/or the power source terminal, e.g., the first power source terminal, the second power source terminal, the third power source terminal, and/or the fourth power source terminal. The computing device can include one or more of a processor, a network interface, a display, or a combination thereof. The computing device can be an artificial intelligence computing device configured to regulate power management by receiving an input signal from the one or more sensors and adjusting the power transmission configuration based on the sensor feedback and optionally other considerations, such as previously powered sections, etc., as described below.

Figure 3:
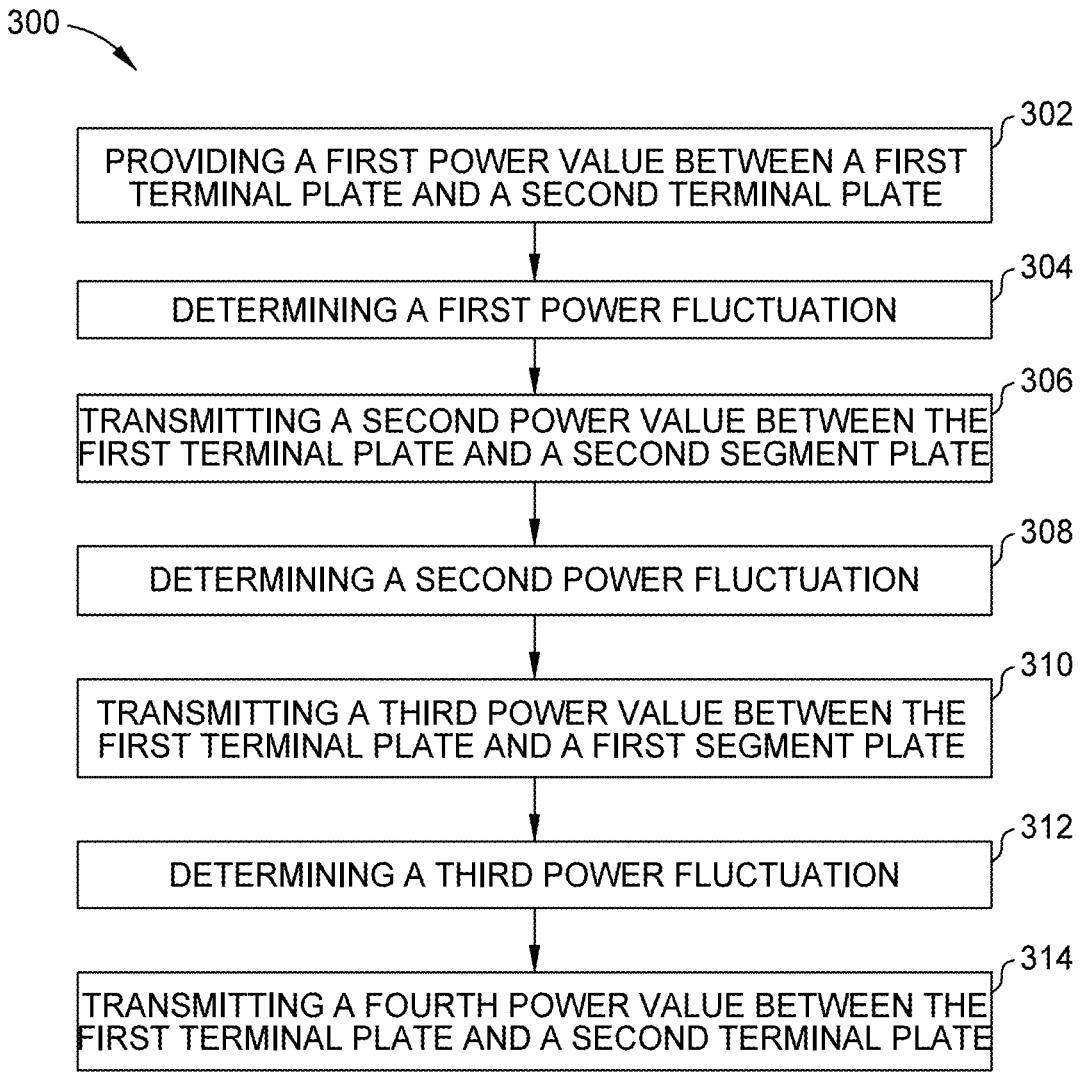
FIG. 3 is a flow diagram of a method for electrolyzing water, according to embodiments of the present disclosure.

FIG. 3 shows a flow diagram of a method 300 for electrolyzing water. The method includes, at step 302, providing the power (at a first power value) to the electrolyzer in a configuration corresponding to a third configuration via a first terminal plate 210A of a first section 202 (e.g., via first power source terminal forming for instance a positive pole of a power source generator) and a second terminal plate 210D of the third section (e.g., via the fourth power source terminal forming for instance a negative pole of the power source generator). The first, second and third sections produce reaction products of an electrolysis reaction, e.g., $H_2$ and $O_2$. The power provided to the electrolyzer is about 100% of the rated power of the entire stack.

At step 304, a first power fluctuation (from an input power transmitted to the electrolyzer stack) is determined. The first power fluctuation includes a transition from a first power value to a second power value. In other words, the input power received from an external power source such as renewable source like a solar or wind power source, is sensed and compared to one or more thresholds. A power fluctuation may correspond to the power fluctuating between below and above a certain threshold. The one or more threshold may be a percentage of the rated stack power, for instance 50% of the stack rated power.

For example, the first power fluctuation can include a decrease of power transmitted to the electrolyzer by a renewable energy source, e.g., solar, wind, hydro, or a combination thereof. The second power value is less than the first power value. For example, the second power value is about 34% to about 67% of the rated electrolyzer power. For example, the rated power of the entire stack can be about 5 MW. The first power value can be from about 2.5 MW to about 5 MW, in which the second power can be about 1.7 MW to about 3.35 MW.

The first power fluctuation may be determined by one or more sensors, e.g., voltage sensors and/or current sensors to detect a voltage drop and/or current drop. Optionally, the first power fluctuation may be determined by a computing device electrically coupled to the multi-section stack electrolyzer based on the sensor feedback. For example, the computing device can receive an input signal from the one or more sensors. The computing device can include one or more of a processor, a network interface, a display, or a combination thereof.

At step 306, the second power value of the input power is transmitted to the electrolyzer in a configuration corresponding to a first configuration, e.g., between the first terminal plate 210A (e.g., via first power source terminal forming for instance a positive pole of a power source generator) and the second segment plate 210C (e.g., via third power source terminal forming for instance a negative pole of a power source generator).

Optionally, the second power value is less than the first power value. The power at the second power value may be prevented from being transmitted to the second terminal plate 210D. The power may be transmitted from the first terminal plate 210A to the second segment plate 210C such that only the first section and second sections produce reaction products of an electrolysis reaction, e.g., $H_2$ and $O_2$. Without being bound by theory, by preventing the second power from being transmitted to the second terminal plate 210D, the first section 202 and the second section 208 of the multi-section electrolyzer can be operated at about 34% to about 67% of the rated power, thereby maintaining safe HTO levels during operation. Moreover, and without being bound by theory, by preventing the second power from being transmitted to the second terminal plate, the multi-section electrolyzer can be operated without having to shut down the entirety of the electrolyzer.

Optionally, the computing device may receive one or more inputs from the one or more sensors, e.g., voltage sensors, and transmit a signal to the first power source terminal 212A, the second power source terminal 212B, the third power source terminal 212C, and/or the fourth power source terminal 212D to denote a switch from the power being transmitted between the first power source terminal 212A and the fourth power source terminal 212D to the power being transmitted between the first power source terminal 212A and the third power source terminal 212C.

At step 308, a second power fluctuation may be determined. The second power fluctuation can include a transition from the second power value to a third power value. Optionally, the third power value is less than the second power value. For example, the third power value can include a power of about 17% to about 34% of the rated electrolyzer power. For example, the third power value can be about 20% to about 30% of the full rated power. For example, the second power fluctuation can include a further decrease of power emitted to the electrolyzer by a renewable energy source, e.g., solar, wind, water, or a combination thereof.

The second power fluctuation may be determined by one or more sensors, e.g., voltage sensors and/or current sensors to detect a voltage drop and/or current drop. Optionally, the second power fluctuation may be determined by a computing device, described herein, electrically coupled to the multi-section stack electrolyzer. For example, the computing device can receive an input signal from the one or more sensors.

At operation 310, the input power at the third power value may be transmitted between in a configuration corresponding to second configuration of the first terminal plate 210A (e.g., via first power source terminal forming for instance a positive pole of a power source generator) and the first segment plate 210B (e.g., via second power source terminal forming for instance a negative pole of a power source generator). Optionally, the third power value is less than the second power value. The third power value can be transmitted to the electrolyzer of the first section 202 such that only the electrolyzer of the first section 202 may produce reaction products of an electrolysis reaction, e.g., $H_2$ and $O_2$. Optionally, the third power value can be transmitted to the electrolyzer of the second section 208 such that only the electrolyzer of the second section 208 may produce reaction products of an electrolysis reaction, e.g., $H_2$ and $O_2$. Optionally, the third power value can be transmitted to the electrolyzer of the third section 214 such that only the electrolyzer of the third section 214 may produce reaction products of an electrolysis reaction, e.g., $H_2$ and $O_2$. Without being bound by theory, by transmitting the third power value to the electrolyzer of the first section 202, the second section 208, or the third section 214, each electrolyzer of each respective section can be utilized evenly to avoid over using one electrolyzer to cause one electrolyzer to deteriorate faster than other ones. Without being bound by theory, by allowing the third power to be transmitted to the first segment plate, the first section 202 of the multi-section electrolyzer can be operated while maintaining safe HTO levels during operation. Moreover, and without being bound by theory, by allowing the third power value to be transmitted to each section sequentially and/or alternately, the multi-section electrolyzer can be operated continuously even when varying energy output due to intermittent energy output from a renewable energy source occurs.

Optionally, the computing device may receive one or more inputs from the one or more sensors, e.g., voltage sensors, and transmit a signal to the first power source terminal 212A, the second power source terminal 212B, and/or the third power source terminal 212C to denote a switch from the power being emitted between the first power source terminal 212A and the third power source terminal 212C to the power being emitted between the first power source terminal 212A and the second power source terminal 212B. Advantageously, keeping one section or a couple sections in operation during power fluctuation can maintain the remaining sections at an elevated and/or processing temperature, in which when the power is restored, the remaining sections may resume normal operations quicker and with reduced power consumption.

At step 312, a third power fluctuation may be determined. The third power fluctuation can include a transition from the third power value to a fourth power value. Optionally, the fourth power is greater than the third power. For example, the fourth power can include a power of about 50% to about 100% of the rated electrolyzer power. For example, the third power fluctuation can include an increase of power emitted to the electrolyzer by a renewable energy source, e.g., solar, wind, water, or a combination thereof.

Optionally, due to the power fluctuations with renewable energy inputs, the power level can be change from the first power value to the second power value, the first power value to the third power value, the second power value to the third power value, the second power value to the fourth power value, the third power value to the fourth power value, or any power jumps therebetween. The artificial intelligence assisted power management and control system can direct the power to certain section or the combination two section or all three sections of the electrolyzer stack to distribute the power to them in order to maintain the at least 50% power inputs for the certain selected section or sections.

The third power fluctuation may be determined by one or more sensors, e.g., voltage sensors. Optionally, the third power fluctuation may be determined by a computing device, described herein, electrically coupled to the multi-section stack electrolyzer based on the sensors. For example, the computing device can receive an input signal from the one or more sensors.

At operation 314, the input power at the fourth power value may be transmitted in the third configuration, e.g., between the first terminal plate 210A (e.g., via first power source terminal forming for instance a positive pole of a power source generator) and the second terminal plate 210D (via fourth power source terminal forming for instance a negative pole of a power source generator). Optionally, the fourth power value is greater than the second power value and/or the third power value, but lower than the first power value. Optionally, the fourth power value is the same as the first power value. The fourth power value can be transmitted to the first section 202, the second section 208, and the third section 214, such that the first section, 202, the second section 208, and the third section 214 may produce reaction products of an electrolysis reaction, e.g., $H_2$ and $O_2$. Without being bound by theory, by allowing the fourth power value to be transmitted to the second terminal plate, the multi-section electrolyzer can be operated at full power, thereby allowing increased $H_2$ and $O_2$ production upon power restoration.

Optionally, the computing device may receive one or more inputs from the one or more sensors, e.g., voltage sensors, and transmit a signal to the first power source terminal 212A, the second power source terminal 212B, the third power source terminal 212C, and/or the fourth power source terminal 212D to denote a switch from the power being emitted from the first power source terminal 212A and the second power source terminal 212B to the power being emitted from the first power source terminal 212A and the fourth power source terminal 212D.

Figure 4:
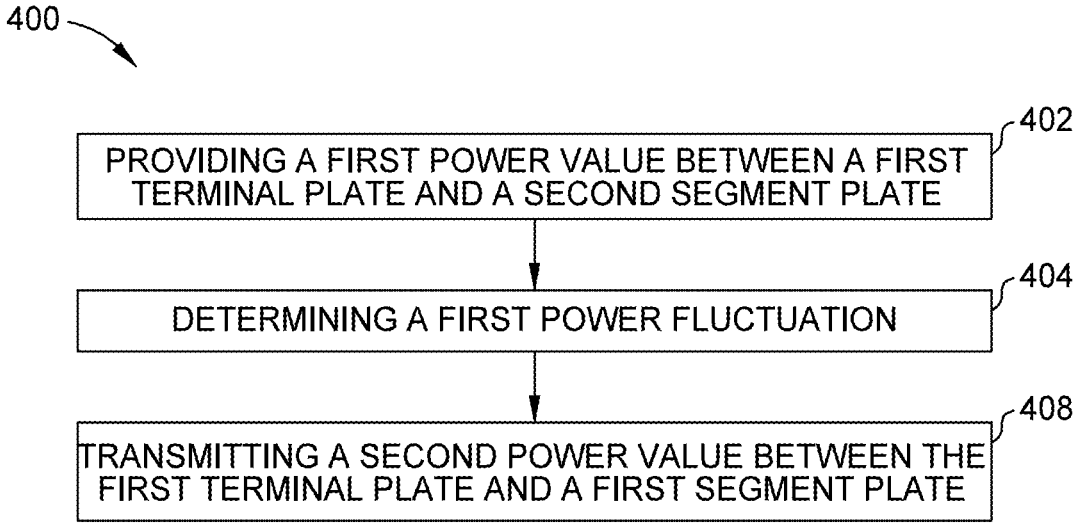
FIG. 4 is a flow diagram of a method for electrolyzing water, according to embodiments of the present disclosure.

Optionally, due to the power fluctuations with renewable energy inputs, the power level can be change from the first power to the second power, the first power to the third power, the second power to the third power, the second power to the fourth power, the third power to the fourth power, or any power changes therebetween. In an embodiment, a power change to provide a power of below 17% of the entire stack rated power, for the exemplary three sections system shown above, may result in a power off state of the electrolyzer to maintain safety. FIG. 4 shows a flow diagram of a method 400 for electrolyzing water. The method includes, at step 402, providing an input power (at a first power value) to the electrolyzer in a configuration corresponding to a first configuration, via a first terminal plate 210A of a first section 202 (e.g., via a first power source terminal forming for instance a positive pole of a power source generator) and a second segment plate 210C of the second section (e.g., via a third power source terminal forming for instance a negative pole of a power source generator). The first, and second sections produce reaction products of an electrolysis reaction, e.g., $H_2$ and $O_2$. The power provided to the electrolyzer is about 50% to about 100% of the rated power of the entire stack.

At step 404, a first power fluctuation (from an input power transmitted to the electrolyzer stack) is determined. The first power fluctuation includes a transition from a first power value to a second power value. In other words, the input power received from an external power source such as renewable source like a solar or wind power source, is sensed and compared to one or more thresholds. A power fluctuation may correspond to the power fluctuating between below and above a certain threshold. The one or more threshold may be a percentage of the rated stack power, for instance 17% of the stack rated power.

For example, the first power fluctuation can include a decrease of power transmitted to the electrolyzer by a renewable energy source, e.g., solar, wind, hydro, or a combination thereof. The first power value is about 50% to 100% of the rated power of the entire stack. The second power value is less than the first power. For example, the second power value is about 34% to about 67% of the rated power of the entire stack. Optionally, the second power value is about 10% to about 90% of the first power, e.g., about 50% to about 90% of the first power or about 70% to about 80% of the first power. For example, the rated power of the entire stack can be about 5 MW. The first power value can be from about 2.5 MW to about 5 MW, in which the second power value can be from about 1.7 MW to about 3.35 MW.

The first power fluctuation may be determined by one or more sensors, e.g., voltage sensors. Optionally, the first power fluctuation may be determined by a computing device electrically coupled to the multi-section stack electrolyzer based on the sensor feedback. For example, an artificial intelligence computing device and power management can receive an input signal from the one or more sensors. The computing device can include one or more of a processor, a network interface, a display, or a combination thereof.

At step 408, the second power value of the input power is transmitted to the electrolyzer in a configuration corresponding to a second configuration, e.g., between the first terminal plate 210A and the first segment plate 210B (e.g., via a second power source terminal forming for instance a negative pole of a power source generator). Optionally, the second power value is less than the first power value. The power at the second power value may be transmitted from the first terminal plate 210A to the first segment plate 210B such that only the first section produces reaction products of an electrolysis reaction, e.g., $H_2$ and $O_2$. Without being bound by theory, by preventing the second power value from being transmitted to the second segment plate, the first section 202 of the multi-section electrolyzer can be operated at about 34% to about 67% of the rated power, thereby maintaining safe HTO levels during operation. Moreover, and without being bound by theory, by preventing the second power value from being transmitted to the second segment plate, the multi-section electrolyzer can be operated without having to shut down the entirety of the electrolyzer.

Optionally, at step 408, the second power value may be alternated between using the first section 202 and the second section 208 such that the electrolyzer cells in each section can be more evenly utilized.

Optionally, the artificial intelligence and power management computing device may receive one or more inputs from the one or more sensors, e.g., voltage sensors, and transmit a signal to the first power source terminal 212A, the second power source terminal 212B, and/or the third power source terminal 212C to denote a switch from the power being emitted from the first power source terminal 212A and the third power source terminal 212C to the power being emitted from the first power source terminal 212A and the second power source terminal 212B.

Optionally, at step 408, a second power fluctuation may be determined. The second power fluctuation can include a transition from the second power value to a third power value. Optionally, the third power value is greater than the second power value. For example, the third power value can include a power of about 50% to about 100% of rated electrolyzer power. For example, the third power value can be from 50% to about 100% of the rated electrolyzer power, where the second power value is from 34% to about 67% of the rated electrolyzer power. For example, the second power fluctuation can include an increase of power emitted to the electrolyzer by a renewable energy source, e.g., solar, wind, hydro or a combination thereof.

The second power fluctuation may be determined by one or more sensors, e.g., voltage sensors. Optionally, the second power fluctuation may be determined by a computing device, described herein, electrically coupled to the multi-section stack electrolyzer. For example, the computing device can receive an input signal from the one or more sensors.

The input power at the third power value may be transmitted in a configuration corresponding to the first configuration between the first terminal plate 210A to the second segment plate 210C, e.g., via the second power source terminal forming for instance a positive pole of a power source generator). Optionally, the third power value is greater than the second power value but lower than the first power value. Optionally, the third power value is the same as the first power value. The third power value can be transmitted to the first section 202 and the second section 208 such that the second section 208 may produce reaction products of an electrolysis reaction, e.g., $H_2$ and $O_2$. Without being bound by theory, by allowing the third power value to be transmitted to the second segment plate, the second section 208 of the multi-section electrolyzer can be operated while maintaining safe HTO levels during operation. Moreover, and without being bound by theory, by allowing the third power value to be transmitted to the second segment plate, the multi-section electrolyzer can be operated continuously even when varying energy output due to intermittent energy output from a renewable energy source occurs.

Optionally, the computing device may receive one or more inputs from the one or more sensors, e.g., voltage sensors, and transmit a signal to the first power source terminal 212A, the second power source terminal 212B, and/or the third power source terminal 212C to denote a switch from the power being emitted from the first power source terminal 212A and the second power source terminal 212B to the power being emitted from the first power source terminal 212A and the third power source terminal 212C.

Optionally, due to the power fluctuations with renewable energy inputs, the power level can be change from the first power value to the second power value, the first power value to the third power value, the second power value to the third power value, the second power value to the fourth power value, the third power value to the fourth power value, or any power value changes therebetween. In an embodiment, a power change to provide a power value of below 17% of the entire stack rated power, for the exemplary three sections system shown above, may result in a power off state of the electrolyzer to maintain safety.

Overall, the present disclosure relates to systems and methods of water electrolysis. The present disclosure includes an electrolyzer having a multi-section stack of electrolyzer cells. The multi-section stack allows each section of the multi-section stack to have independent, but coordinated and intelligently synchronized, power distributed throughout the multi-section stack, thereby allowing for independent and intelligent control of each section of electrolyzer cells. The independent, but coordinated and intelligently synchronized, power of the multi-section stack can allow for renewable energy power output to match the full scale of the rated electrolyzer's power by re-directing the power to one or more sections such that when the renewable power decreases, the power can be re-directed to maintain at least 50% of the rated power for one or more sections of the multi-section stack. The maintenance of at least 50% of the rated power can maintain lower HTO levels for each section, and allow the renewable energy to continue to power the electrolyzer even as the power drops to about 17% of the rated power for the electrolyzer for the described case of three sections The multi-section stack of the present disclosure can thus be powered by a renewable energy source continuously even during periods of intermittent power output.

The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the present disclosure, additionally, they do not exclude impurities and variances normally associated with the elements and materials used.

Numerical ranges used herein include the numbers recited in the range. For example, the numerical range "from 1 wt % to 10 wt %" includes 1 wt % and 10 wt % within the recited range.

For the sake of brevity, only some ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

All numerical values within the detailed description herein are modified by "about" the indicated value, and take into account experimental error and variations that would be expected by a person having ordinary skill in the art.

All documents described herein are incorporated by reference herein, including any priority documents and or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

The specific embodiments described herein have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

EMBODIMENTS

Implementation examples are described in the following numbered clauses.

E1. A system for electrolyzing water, the system comprising an electrolyzer stack having at least two sections, wherein the at least two sections include: a first section defined by a first terminal plate and a first segment plate, the first section comprising at least one electrolyzer cell, wherein the at least one electrolyzer cells comprises: a first electrode disposed adjacent to the first terminal plate and in electrical contact with the first terminal plate; a second electrode disposed adjacent to a first side of the first segment plate and in electrical contact with the first segment plate; a second section defined by the first segment plate and a second segment plate, the second section comprising at least one electrolyzer cell, wherein the second plurality of electrolyzer cells comprises: a third electrode disposed adjacent to a second side of the first segment plate and in electrical contact with the first segment plate, the first side of the first segment plate opposite the second side of the first segment plate; a fourth electrode disposed adjacent to a first side of the second segment plate and in electrical contact with the first side of the second segment plate; and a power source terminal electrically coupled to the first terminal plate, the first segment plate, and the second segment plate.

E2. The system of embodiment E1, wherein the system further comprises a third section defined by the second segment plate and a second terminal plate, the third section comprising at least an electrolyzer cell, wherein the third plurality of electrolyzer cells comprises: a fifth electrode disposed adjacent to a second side of the second segment plate and in electrical contact with the second segment plate, the first side of the second segment plate opposite the second side of the second segment plate; a sixth electrode disposed adjacent to the second terminal plate and in electrical contact with the second terminal plate.

E3. The system of embodiment E2, wherein a second power source terminal is electrically coupled to the second terminal plate.

E4. The system of any one of embodiments E1-E3, further comprising a sensor configured to detect a power fluctuation.

E5. The system of any one of embodiments E1-E4, further comprising a computing device communicatively coupled to the first section, and the second section, wherein the computing device is configured to: receive one or more inputs from the sensor; and transmit a signal to a first power source terminal electrically coupled to the first terminal plate, a second power source terminal electrically coupled to the first segment plate, or a third power source terminal electrically coupled to a second segment plate to denote a switch from a power being transmitted between the first power source terminal and the third power source terminal to a power being transmitted between the first power source terminal and the second power source terminal.

E6. A method of electrolyzing water, the method comprising: providing an electrolyzer stack having a plurality of sections including at least a first and a second section, wherein the first section is defined by a first terminal plate and a first segment plate and the second section is defined by the first segment plate and a second segment plate providing a power at a first power value between the first terminal and the second segment plate, thereby powering the first and second sections; determining a power fluctuation from the first power value to a second power value; and transmitting the second power from the first terminal plate to the first segment plate, thereby power the first section but not the second.

E7. The method of embodiment E6, wherein the second power value is less than the first power value.

E8. The method of embodiments E6 or E7, further comprising determining a second power fluctuation from the second power value to a third power value.

E9. The method of embodiment E8, wherein third power value is greater than the second power value.

E10. The method of embodiment E9, further comprising transmitting the power between the first terminal plate and the second segment plate, thereby powering the first and second sections.

E11. A method of electrolyzing water, comprising: providing an electrolyzer stack having a plurality of sections including at least a first and a second section, wherein the first section is defined by a first plate and a second plate and the second section is defined by the second plate and a third plate; sensing an input power transmitted to the stack from an external power source; selecting, based on the input power, a power transmission configuration between at least a first and a second configuration, wherein the first configuration comprises transmitting power to the first and the second sections via the first plate and the third plate, and wherein, the second configuration comprises transmitting power to the first section via the first and second plates; transmitting the input power to the selected power transmission configuration.

E12. The method of embodiment E11, wherein the first plate comprises a first terminal plate, the second plate comprises a first segment plate, and the third plate comprises a second segment plate E13. The method of embodiment E12, wherein the electrolyzer stack comprises a third section defined by the third plate and a fourth plate.

E14. The method of embodiment E13, wherein the fourth plate comprises a second terminal plate.

E15. The method of embodiment E13, further comprising selecting, based on the input power, a power transmission between at least the first, the second and a third configuration.

E16. The method of embodiment E15, wherein the third configuration comprises transmitting power to the first, second and third sections via the first and fourth plates.

E17. The method of any one of embodiments E11-E16, wherein selecting the power transmission configuration comprises comparing the sensed input power to one or more thresholds.

E18. The method of embodiment E17, wherein the input power is transmitted in the second configuration when the sensed input power is below a first threshold.

E19. The method of embodiment E18, wherein the input power is transmitted in the first configuration when the sensed input power is below a second threshold.

E20. The method of embodiment E19, wherein the second threshold is above the first threshold.

While the present disclosure has been described with respect to a number of embodiments and examples, those skilled in the art, having benefit of this disclosure, will appreciate that other embodiments can be devised which do not depart from the scope and spirit of the present disclosure.

What is claimed is:

1. A method of electrolyzing water, the method comprising:

providing an electrolyzer stack having a plurality of sections including at least a first section and a second section, wherein the first section is defined by a first terminal plate and a first segment plate and the second section is defined by the first segment plate and a second segment plate;

providing an input power at a first power value between the first terminal plate and the second segment plate, thereby powering the first and second sections;

determining a power fluctuation from the first power value to a second power value, wherein the power fluctuation is determined by one or more sensors electrically coupled to the electrolyzer stack; and transmitting the second power value from the first terminal plate to the first segment plate, wherein transmitting comprises a computing device receiving an input signal from the one or more sensors and transmitting a signal to a power source terminal electrically coupled to the first segment plate to switch from a first power source terminal connection to the second segment plate to a second power source terminal connection to the first segment plate.

2. The method of claim 1, wherein the second power value is less than the first power value.

3. The method of claim 1, further comprising determining a second power fluctuation from the second power value to a third power value.

4. The method of claim 3, wherein the third power value is greater than the second power value.

5. The method of claim 2, further comprising transmitting the input power between the first terminal plate and the second segment plate, thereby powering the first and second sections.

6. The method of claim 4, wherein the method further comprises:

sensing an input power transmitted to the electrolyzer stack from an external power source; and selecting, based on the sensed input power, a power transmission configuration between at least a first configuration and a second configuration, wherein the first configuration comprises transmitting power to the first and second sections via the first terminal plate and the second segment plate, and the second configuration comprises transmitting power to the first section via the first terminal plate and the first segment plate, wherein selecting the power transmission configuration comprises comparing the input power to one or more thresholds.

7. The method of claim 6, wherein the input power is transmitted in the second configuration when the input power is below a first threshold.

8. The method of claim 7, wherein the input power is transmitted in the first configuration when the input power is below a second threshold.

9. The method of claim 8, wherein the second threshold is above the first threshold.

10. A method of electrolyzing water, the method comprising:

providing an electrolyzer stack having a plurality of sections including at least a first section and a second section, wherein the first section is defined by a first terminal plate and a first segment plate and the second section is defined by the first segment plate and a second segment plate;

providing an input power at a first power value between the first terminal plate and the second segment plate, thereby powering the first and second sections;

determining a power fluctuation from the first power value to a second power value, wherein the power fluctuation is determined by one or more sensors electrically coupled to the electrolyzer stack, and wherein the second power value is less than the first power value;

determining a second power fluctuation from the second power value to a third power value, wherein the third power value is greater than the second power value;

sensing, via at least one sensor, input power transmitted to the electrolyzer stack from an external power source;

selecting, based on the sensed input power, a power transmission configuration between at least a first configuration and a second configuration, wherein the first configuration comprises transmitting power to the first and second sections via the first terminal plate and the second segment plate, and the second configuration comprises transmitting power to the first section via the first terminal plate and the first segment plate;

transmitting the second power value from the first terminal plate to the first segment plate, wherein transmitting comprises a computing device receiving an input signal from the one or more sensors and transmitting a signal to a power source terminal electrically coupled to the first segment plate to switch from a first power source terminal connection to the second segment plate to a second power source terminal connection to the first segment plate; and transmitting the input power between the first terminal plate and the second segment plate, thereby powering the first and second sections, wherein selecting the power transmission configuration comprises comparing the input power to one or more thresholds, wherein the input power is transmitted in the second configuration when the input power is below a first threshold, wherein the input power is transmitted in the first configuration when the input power is below a second threshold, and wherein the second threshold is above the first threshold.

* * * * *